US009644619B2

(12) United States Patent
Nagl

(10) Patent No.: US 9,644,619 B2
(45) Date of Patent: May 9, 2017

(54) COMPRESSION MACHINE WITH A BODY OSCILLATING BETWEEN TWO REVERSAL POINTS

(71) Applicant: LINDE AKTIENGESELLSCHAFT, München (DE)

(72) Inventor: Christoph Nagl, Österreich (AU)

(73) Assignee: Linde Aktiengesellschaft, Munich (DE)

( * ) Notice: Subject to any disclaimer, the term of this patent is extended or adjusted under 35 U.S.C. 154(b) by 101 days.

(21) Appl. No.: 14/783,549

(22) PCT Filed: Mar. 27, 2014

(86) PCT No.: PCT/EP2014/000830
§ 371 (c)(1),
(2) Date: Oct. 9, 2015

(87) PCT Pub. No.: WO2014/169987
PCT Pub. Date: Oct. 23, 2014

(65) Prior Publication Data

US 2016/0061195 A1 Mar. 3, 2016

(30) Foreign Application Priority Data

Apr. 16, 2013 (DE) ..... 10 2013 006 577

(51) Int. Cl.
*F04B 19/22* (2006.01)
*F04B 35/04* (2006.01)
(Continued)

(52) U.S. Cl.
CPC ..... *F04B 19/22* (2013.01); *F04B 35/01* (2013.01); *F04B 35/04* (2013.01); *F04B 37/08* (2013.01); *F04B 37/18* (2013.01); *F04B 37/20* (2013.01)

(58) Field of Classification Search
USPC ..... 92/261
See application file for complete search history.

(56) References Cited

U.S. PATENT DOCUMENTS 3,459,364 A * 8/1969 Madsen ..... F04B 39/12 220/324
5,400,751 A * 3/1995 Grimmer ..... F04B 25/00 123/192.2
8,398,385 B2 * 3/2013 Freiberger ..... F04B 39/10 417/437

FOREIGN PATENT DOCUMENTS

DE 417683 C 8/1925
DE 101 39 617 A1 7/2002
(Continued)

OTHER PUBLICATIONS

International Search Report for PCT/EP2014/000830, Date of Mailing: Jun. 30, 2014, Authorized Official: Wolfgang Birling, 5 pages.
(Continued)

*Primary Examiner* — Thomas E Lazo
(74) *Attorney, Agent, or Firm* — Joshua L. Cohen

(57) ABSTRACT

A compression machine (110) includes an oscillating body (111) oscillating between two reversal points ($U_1$, $U_2$), wherein the oscillating body has a first mass ($m_1$), and a maximum value of resulting compression force (F*) when the oscillating body is used is less by a predetermined factor (F) than a maximum value of the resulting compression force when an oscillating reference body (121) having a reference mass ($m_{ref}$) is used in a reference compression machine (120) of same construction and using the same fluid (112), wherein the first mass exceeds the reference mass by a percentage that is a function of the predetermined factor, and wherein maximum value of the resulting compression force is reduced by the predetermined factor F by reducing cross-sectional area (A) of the oscillating reference body if the oscillating reference body were used. A related method is also provided.

10 Claims, 3 Drawing Sheets

(51) Int. Cl.

| | |
|---|---|
| ***F04B 37/08*** | (2006.01) |
| ***F04B 37/18*** | (2006.01) |
| ***F04B 37/20*** | (2006.01) |
| ***F04B 35/01*** | (2006.01) |

(56) References Cited

FOREIGN PATENT DOCUMENTS

| | | |
|---|---|---|
| DE | 198 50 722 C1 | 4/2003 |
| DE | 10 2009049988 A1 | 4/2011 |

OTHER PUBLICATIONS

Written Opinion of the International Searching Authority for PCT/EP2014/000830, Date of Mailing: Jun. 30, 2014, Authorized Official: Nikolaos Fistas, 4 pages.

* cited by examiner

COMPRESSION MACHINE WITH A BODY OSCILLATING BETWEEN TWO REVERSAL POINTS

The invention relates to a compression machine, a method for designing the same, and a use thereof.

Under normal conditions, gases have very low density. In order to be able to store a gas efficiently, the mass of the gas in the available storage space must be increased. The mass of a gas in a constant volume can be increased in accordance with the thermal state equation for ideal gases by increasing the gas pressure or reducing the temperature of the gas. Effective storage of gases is usually achieved by increasing the gas pressure.

Hydrogen, for example, is becoming increasingly important as a fuel for motor vehicles. However, the options for isolating hydrogen are limited, and result in quantities of hydrogen being lost as boil-off gas, so hydrogen is usually stored in high pressure gas tanks in motor vehicles.

The gas pressure can be increased using various compression machines, for example by means of a reciprocating piston compressor. However, the force these compression machines are able to generate is inherently limited by their design. If the compression machine is driven by an electric motor, a linear motor for example, the maximum force that can be generated is limited by the maximum driving force of which the electric motor is capable.

An increase in the gas pressure is accompanied by an increase in a resulting compression force. This resulting compression force is defined as a difference between the piston force exerted on the gas by the compression machine and a gas force exerted on the compression machine by the gas.

A resulting increase in compression force entails high loads, which in turn place increased demands on the materials that make up the compression machine. If the maximum force the compression machine can generate is limited, it is very important to keep the resulting compression force as low as possible by appropriate structural design. The maximum force the compression machine can generate thus represents the limit of the gas force and accordingly the delivery capacity of the compressing machine as well.

Compressed fluid that has reached a desired density is transported away from the compression machine, and at the same time a fresh supply of uncompressed fluid is introduced into the compression machine. A quantity of the compressed fluid that is discharged from the compression machine determines the delivery capacity of the compression machine.

In a reciprocating piston compressor for example, the resulting compression force can be lowered while maintaining constant gas pressure with negligible frictional force by reducing an effective cross sectional area of the reciprocating piston.

However, reducing the effective cross sectional area of the reciprocating piston inevitably entails a reduction in the delivery capacity of the compression machine.

It is therefore desirable to provide a compression machine with which the resulting compression force and thus also the loads and requirements to which the compression machine is subjected can be reduced, without also having to sacrifice delivery capacity.

This object is solved with a compression machine according to the invention, a method and use of such a compression machine according to the independent claims. In the compression machine according to the invention, an oscillating body oscillates between two reversal points. In a first stage, a fluid is compressed by the movement of the oscillating body in a first direction. In a second stage, the fluid is decompressed by the movement of the oscillating body in a second direction opposite to the first direction (corresponding proportionally to the dimension of the dead space volume). In so doing, the oscillating body exerts a piston force (a combination of the mass force of the inertial mass and the motor/drive force) on the fluid, and the fluid exerts a fluid force on the oscillating body. A resulting compression force is defined as a difference between the fluid force and the piston force.

The oscillating body has a first mass, wherein a maximum value of the resulting compression force when the oscillating body having the first mass is used is less by a predetermined factor F than a maximum value of the resulting compression force when an oscillating reference body having a reference mass is used in a reference compression machine of the same construction and using the same fluid.

The first mass is greater than the reference mass by a percentage that is a function of the predetermined factor. If the oscillating reference body were used, reducing an effective cross-sectional area of the oscillating reference body would reduce the maximum value of the resulting compression force by precisely said predetermined factor F.

While working on the invention, it was found that not only can a maximum value of the resulting compression force be reduced by decreasing the effective cross-sectional area of the oscillating body, but also that increasing the mass of the oscillating body also has the effect of reducing the maximum value of the resulting compression force. The invention is based on the finding that by increasing the mass of the oscillating body it is possible to reduce the maximum value of the resulting compression force by the same factor as when the effective cross-sectional area of the oscillating body is reduced.

According to the invention, the oscillating body therefore has a first mass. The first mass is greater than a reference mass by a given percentage. The maximum value of the compression force resulting when the oscillating body with the first mass is used, is less than a maximum value of the compression force resulting when an oscillating reference body with the reference mass is used by a predetermined factor F. In this context, the oscillating reference body with the reference mass is used in a reference compression machine with the same construction as the compression machine according to the invention. And the same fluid is used in both the inventive compression machine and the reference compression machine. The percentage by which the first mass is greater than the reference mass is a function of the predetermined factor.

If the effective cross-sectional area of the oscillating reference body in the reference compression machine were reduced, this would cause the resulting compression force to be reduced by the same predetermined factor F when the oscillating reference body was used.

The maximum value of the resulting compression force does not necessarily occur at the reversal point between the first and second stages, but may shift due to the superposition of the oscillating mass force (or more generally the piston force) (see exemplary embodiment, FIG. 2*b*).

The inventive increase in the mass of the oscillating body compared to the reference body has the effect of decreasing the maximum value of the resulting compression force. The increase in the mass of the oscillating body causes an increase in an inertial force of the oscillating body. The reversal points, which represent dead points in the oscillating motion of the oscillating body, are thus overcome more easily. The effect of the fluid on the oscillating body and thus also on the resulting compression force are accordingly reduced. Figuratively speaking, the increase in the mass of the oscillating body has the same effect as a flywheel on a motor vehicle powered by an internal combustion engine.

For the purposes of the invention, the first mass is chosen such that the maximum value of the resulting compression force is reduced in controlled manner to a desired value. For example, the maximum value of the resulting compression force of the reference compression machine with the reference body can exceed predetermined specifications, a permissible maximum value or a maximum force value that can be supplied by a drive unit. It follows that this maximum value of the resulting compression force of the reference compression machine should be reduced by the predetermined factor F so that the reference compression machine satisfies the prescribed specifications, etc. The reference body is accordingly "swapped" with the correspondingly chosen first mass, wherein the first mass is larger by a certain percentage that is dictated by precisely this predetermined factor.

Unlike reducing the effective cross sectional area of the oscillating reference body, the fact of increasing the mass of the oscillating body in comparison to the reference body does not result in any losses of delivery capacity. The invention makes it possible to effectively reduce the resulting compression force and therewith also the loads and requirements imposed on the compression machine compared with the reference compression machine without having to sacrifice any of the delivery capacity. This in turn helps to prolong service live and extend maintenance intervals. At the same time, no complex, elaborate or expensive modifications need to be made to the reference compression machine. The structure of the reference compression machine can still be used. Only the oscillating reference body has to be replaced with a more massive oscillating body, which is not associated with any great expense.

A compression machine according to the invention enables greater maximum delivery and higher maximum fluid pressure of the compressed fluid than is possible with a reference compression machine. A compression machine according to the invention with, for example, a lower driving force or lower inertial force than a reference compression machine, can still generate the same fluid pressure on the compressed fluid and the same delivery capacity as the reference compression machine.

The oscillating body and the reference body particularly have the same density. Accordingly, the oscillating body has a larger volume than the reference body. Alternatively, the oscillating body and the reference body may be made from materials having different densities and still have the same and/or different volumes.

In addition to or alternatively to the mass of the oscillating body, an oscillation frequency of the oscillating movement of the oscillating body is also increased to advantageous effect; separate protection is expressly reserved for this alternative configuration. A maximum value of the speed of the oscillating body is thus increased. The maximum value of the compression force resulting when the oscillating body with the first (increased) mass is used in conjunction with the (increased) oscillation frequency is lower by a second predetermined factor than the maximum value of the resulting compression force when the oscillating reference body with reference mass and a reference frequency is used in the reference compression machine. In this context, the second predetermined factor is greater than the first predetermined factor.

The oscillation frequency is greater than the second reference frequency by a second percentage that is a function of said second predetermined percentage. According to a particularly advantageous embodiment of the compression machine according to the invention, the oscillating body has a greater mass than the reference body and oscillates at a higher frequency than the reference body. The effect of the increased inertial force may thus be further amplified.

In a manner similar to that described in the preceding text, the first mass may be larger than the reference body by the percentage that is a function of the predetermined factor, so that the maximum value of the resulting compression force of the reference compression machine is reduced by the given factor. In order to reduce the maximum value of the resulting compression force of the reference compression machine further, by the second predetermined factor in all, the oscillation frequency can also be increased compared to the reference frequency. For illustrative purposes, a rough adjustment of the maximum compression force value can thus be made by replacing the reference body with the oscillating body and this setting can be fine-tuned by increasing the reference frequency to the oscillation frequency until the maximum compression force value reaches a desired predetermined value.

It is also conceivable for the first mass and the oscillation frequency to be chosen as a function of each other. If the maximum compression force value of the reference compression machine is to be reduced by the predetermined second factor using the reference body, the first mass and the oscillation frequency are each increased compared to the reference body and the reference frequency by a percentage that is a function of the second predetermined factor.

As an alternative to simply increasing the mass of the oscillating body, according to this variant of the invention the maximum value of the resulting compressing force may be adjusted to prescribed specifications more flexibly and with greater range by selecting both the first mass and the oscillation frequency appropriately, optionally as a function of each other.

When the oscillating body with the first mass is used, optionally with the oscillation frequency, the maximum value of the resulting compression force is preferably lower than a maximum value of a driving force provided by a drive unit of the compression machine. If the mass of the oscillating body is increased and/or the frequency of the oscillating body is raised further, the maximum value of the resulting compression force can be reduced such that the maximum value of the resulting compression force is sufficient for the limited maximum achievable driving force of the compression machine drive unit. The compression force occurring due to the compression of the fluid is reduced by the invention to such a degree that the drive unit of the compression machine is able to provide said compressing force or compensate for it.

The oscillating body is preferably constructed as a reciprocating piston and/or the compression machine preferably in the form of a reciprocal piston compressor. However, the invention is not intended to be limited to reciprocating piston compressors. In principle, the invention is intended to be used for any compression machine, or generally for any device in which a mass of a body oscillating between two reversal points is used to do work.

For example, the invention is also suitable for a scroll compressor, in which two interleaved spirals rotate in opposite directions to each other. The spirals may be offset relative to each other by means of eccentrics. A body oscillating between two reversal points performs a linear oscillating motion inside each of the eccentrics. This linear movement, which is converted into the rotating movement of the spirals, is ultimately used to compress and decompress a fluid. Thus, the invention is also applicable for the oscillating bodies of eccentrics, for example, that are operated in combination with a scroll compressor.

In practice, efforts may be made to achieve a maximum value of the resulting compression force that is less by a predetermined factor F than the corresponding value of the resulting compression force of a reference compression machine, wherein this factor may preferably have values from 0.2 to 0.9, and wherein the compression force is then consequently reduced to 20 to 90% of the reference compression force. Values in the order of 50 or between 70 and 80% are preferred.

The increase in mass relative to the reference mass necessary for this is advantageously up to about 300%. In particular, the first mass is 50, 100, 150, 200, 250, or 300% greater than the reference mass. A range between 100 and 200% is particularly preferred.

The notes above regarding the first factor also apply for the second factor. If the oscillation frequency is increased, the reduction in compression force by the first factor already achieved is reduced still further, by said second factor. For this purpose, the oscillation frequency is selected to be higher than the reference frequency by a second percentage. Again, values such as were indicated above for the first percentage may also be specified for this second percentage. Percentages from 50 to 150% are particularly preferred.

While the resulting compression force can be reduced to about 70% of the initial value by doubling the mass, for example, the compression force can only be lowered to about 80% of the original value (see embodiments below) by doubling the oscillating frequency alone.

The invention further relates to a method for designing a compression machine, wherein according to the invention the mass of the oscillating body is increased by a percentage in defined manner as described previously. As was described in detail above, this percentage is a function of the factor by which the maximum value of the resulting compression force is to be reduced. Variations of the method according to the invention will similarly be apparent from the above description of the compression machine according to the invention. The same applies to the inventive use of this compression machine.

BRIEF DESCRIPTION OF THE DRAWINGS

The invention will now be explained in greater detail with reference to the accompanying drawings. In the drawings.

DETAILED DESCRIPTION OF INVENTION

Figure 1A:
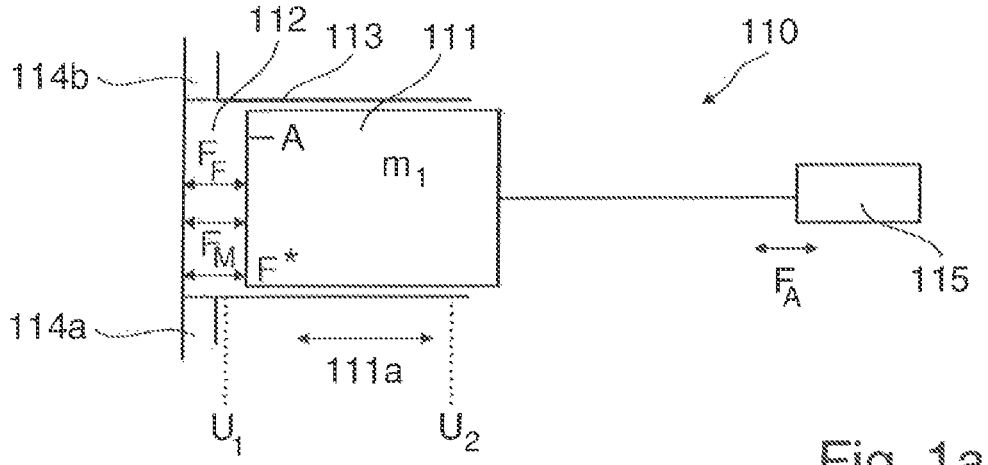
FIG. 1 is a diagrammatic representation of one variant of a compression machine according to the invention (FIG. 1*a*) and two reference compression machines (FIGS. 1*b*, 1*c*)

A preferred embodiment of a compression machine according to the invention is represented diagrammatically in FIG. 1*a* and identified with the numeral 110. The compression machine in this example is a reciprocating piston compressor 110.

Reciprocating piston compressor 110 is driven by a linear motor 115. Linear motor 115 is able to supply a maximum driving force $F_A$. With this supplied force $F_A$, linear motor 115 drives an oscillating body of reciprocating piston compressor 110. The oscillating body is a reciprocating piston 111. Reciprocating piston 111 has a first mass $m_1$ and an effective cross-sectional area A. Reciprocating piston 111 is moved in oscillating manner inside cylinder 113 under the force $F_A$ exerted on reciprocating piston 111 by linear motor 115 and oscillates between two reversal points $U_1$ and $U_2$, indicated by double-headed arrow 111*a*. A frequency at which this oscillating motion 111*a* of reciprocating piston 111 occurs is predetermined by linear motor 115.

In a first stage, piston 111 moves from second reversal point $U_2$ to first reversal point $U_1$ and in the process compresses a fluid 112. In a second stage, piston 111 moves from reversal point $U_1$ to second reversal point $U_2$ and decompresses fluid 112 (corresponding proportionally to the dimension of the dead space volume). Fluid 112 is able to flow into the cylinder via a feed line 114*a*, and exit the cylinder via a drain line 114*b*. During the oscillating movement 111*a*, piston 111 exerts a piston force $F_M$ on fluid 112 and the fluid exerts a fluid force $F_F$ on piston 111. A resulting compression force F* is formed as the difference between piston force $F_M$ and fluid force $F_F$.

Since each force changes direction depending on the stage of oscillating motion 111*a* being performed by the reciprocating piston 111, the forces in FIG. 1 are each represented by a double-headed arrow.

Figure 1B:
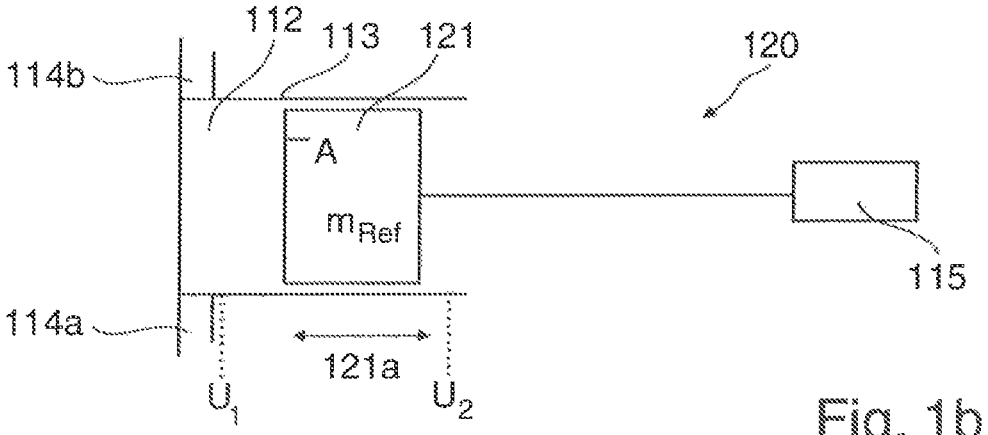

FIG. 1*b* is a schematic representation of a reference compression machine, which is designated with the numeral 120. Reference compression machine is also a reciprocating piston compressor. This reciprocating piston compressor 120 is of the same construction as reciprocating piston compressor 110, except that reciprocating piston 111 has been replaced with a reference body in the form of a reference reciprocating piston 121. Reference reciprocating piston 121 has the same effective cross-sectional area (diameter 42 mm) and density as reciprocating piston 111, but reference reciprocating piston 121 has a smaller volume and thus also a reference mass $m_{ref}$, which is smaller than first mass $m_1$. Reference reciprocating piston 121 is also driven by linear motor 115 to perform an oscillating movement 121*a* between the two reversal points $U_1$ and $U_2$, so that reference reciprocating piston 121 also decompresses (corresponding proportionally to the dimension of the dead space volume) and compresses fluid 112 by turns.

Since first mass $m_1$ is larger than reference mass $m_{ref}$, a maximum value of the resulting compression force F* exerted by reciprocating piston compressor 110 is smaller than a maximum value of the resulting compression force F* exerted by reference reciprocating piston compressor 120 by a predetermined factor F. First mass $m_1$ is larger than reference mass $m_{ref}$, by a percentage that is a function of said factor F.

Figure 1C:
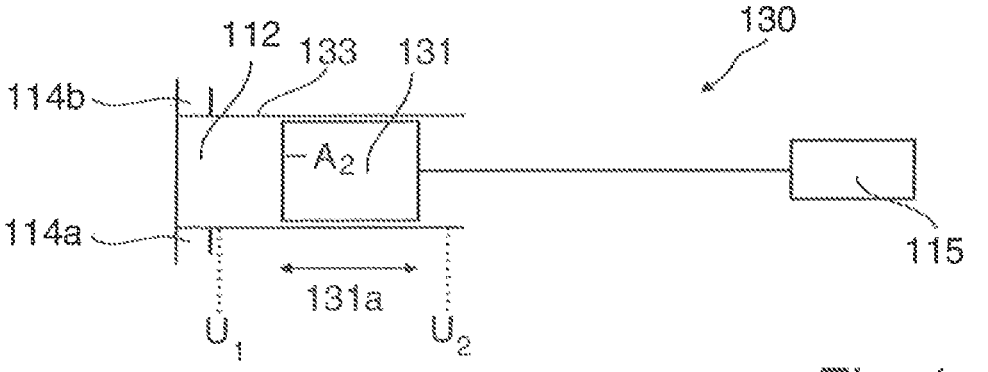

This reduction of the maximum value of the resulting compression force F* by a factor F would also not be achieved if the effective cross-sectional area A of reference reciprocating piston 121 were reduced. Accordingly, FIG. 1*c* is a diagrammatic representation of a second reference reciprocating piston compressor 130 having a second reference reciprocating piston 131 with an effective cross-sectional area $A_2$ (diameter 16 mm), wherein effective cross-sectional area $A_2$ is smaller than effective cross-sectional area A. Similarly to second reference reciprocating piston 131, a second cylinder 133 of second reference reciprocating piston compressor 130 has a smaller cross section than cylinder 113. Second reference reciprocating piston compressor 130 is also driven by linear motor 115 driven and also compresses and decompresses (corresponding proportionally to the dimension of the dead space volume) fluid 112 in alternating manner via an oscillating movement 131*a*. The maximum value of the compression force F* resulting from second reference reciprocating piston compressor 130 is the same as the maximum value of the compression force F* resulting from reciprocating piston compressor 110.

Real examples of the compressor calculated and configured in this embodiment (see FIG. 2): reference compressor: $m_{ref}$=16 kg, f=10 Hz=$f_{osc}$=$f_{ref}$, |F*1 max@10 Hz|=12.33 kN, mass doubled $m_1$=2×$m_{ref}$, |F*2 max@10 Hz|=8.9 kN; two-and-a-half times mass: $m_1$=2.5×$m_{ref}$, |F*max@10 Hz|=7.35 kN.

Note: There is no linear correlation between increasing the mass and reducing F*. The mass must always be increased specifically for the entire system, so it is not possible to make a blanket statement covering each system. In principle, it should be noted that an increase is useful up to the degree at which the respective quantity-related maximum value of the oscillating piston force, plotted against time/angle, is smaller than or equal to the quantity-related maximum value of the resulting compression force, again plotted against time/angle, of the reference compressor (addition of forces would not yield any advantage beyond this).

Until now, we have only discussed the case in which all movements 111*a*, 121*a* and 131*a* take place at the same frequency. Now the case is to be considered in which the oscillating movements 121*a* and 131*a* of reference reciprocating piston 121 and those of second reference reciprocating piston 131 are each performed at a reference frequency $f_{ref}$. On the other hand, the oscillating movement 111*a* of reciprocating piston 111 takes place at an oscillation frequency $f_{osc}$, reference frequency $f_{ref}$ being lower than oscillation frequency $f_{osc}$. In this case, the associated maximum value of the resulting compression force F* of reciprocating piston compressor 110 is also the same as the maximum value of the resulting compression force F* of second reference reciprocating piston 130 and less than the maximum value of the resulting compression force F* of reference reciprocating piston compressor 120 by a second factor. Oscillation frequency $f_{osc}$ and first mass $m_1$ are each respectively greater than the reference mass $m_{ref}$ and reference frequency $f_{ref}$a by a percentage that is a function of the second factor.

Real examples of the compressor calculated and configured in this embodiment (see FIG. 2): reference compressor: $m_{ref}$=16 kg, f.osc. 1=5 Hz==$f_{ref}$, |F*1 max@5 Hz 1=14.93 kN, frequency×1.5, $f_{osc}$=7.5 Hz, |F*2 max@7.5 Hz|=13.84 kN; frequency doubled: $f_{osc}$=10 Hz, |F*3 max@10 Hz|=12.33 kN.

Note: There is no linear correlation between increasing the frequency and reducing F*. The frequency must always be increased specifically for the entire system, so it is not possible to make a blanket statement covering each system. In principle, it should be noted that an increase is useful up to the degree at which the respective quantity-related maximum value of the oscillating piston force, plotted against time/angle, is smaller than or equal to the quantity-related maximum value of the resulting compression force, again plotted against time/angle, of the reference compressor; addition of forces would not yield any advantage beyond this.

FIG. 2 shows two schematic diagrams, which can be included in one embodiment of a compression machine according to the invention. For this particular example, a reciprocating piston compressor 110 according to FIG. 1*a* is assumed, in which first mass $m_1$ of reciprocating piston 111 has a value of 50 kg. The stroke, that is to say the distance between the two reversal points $U_1$ and $U_2$, is 120 mm, the oscillation frequency of oscillating movement 111*a* is 10 Hz, one period of oscillating movement 111*a* lasts 100 ms. Linear motor 115 can provide a maximum driving force of 13.8 kN.

Figure 2A:
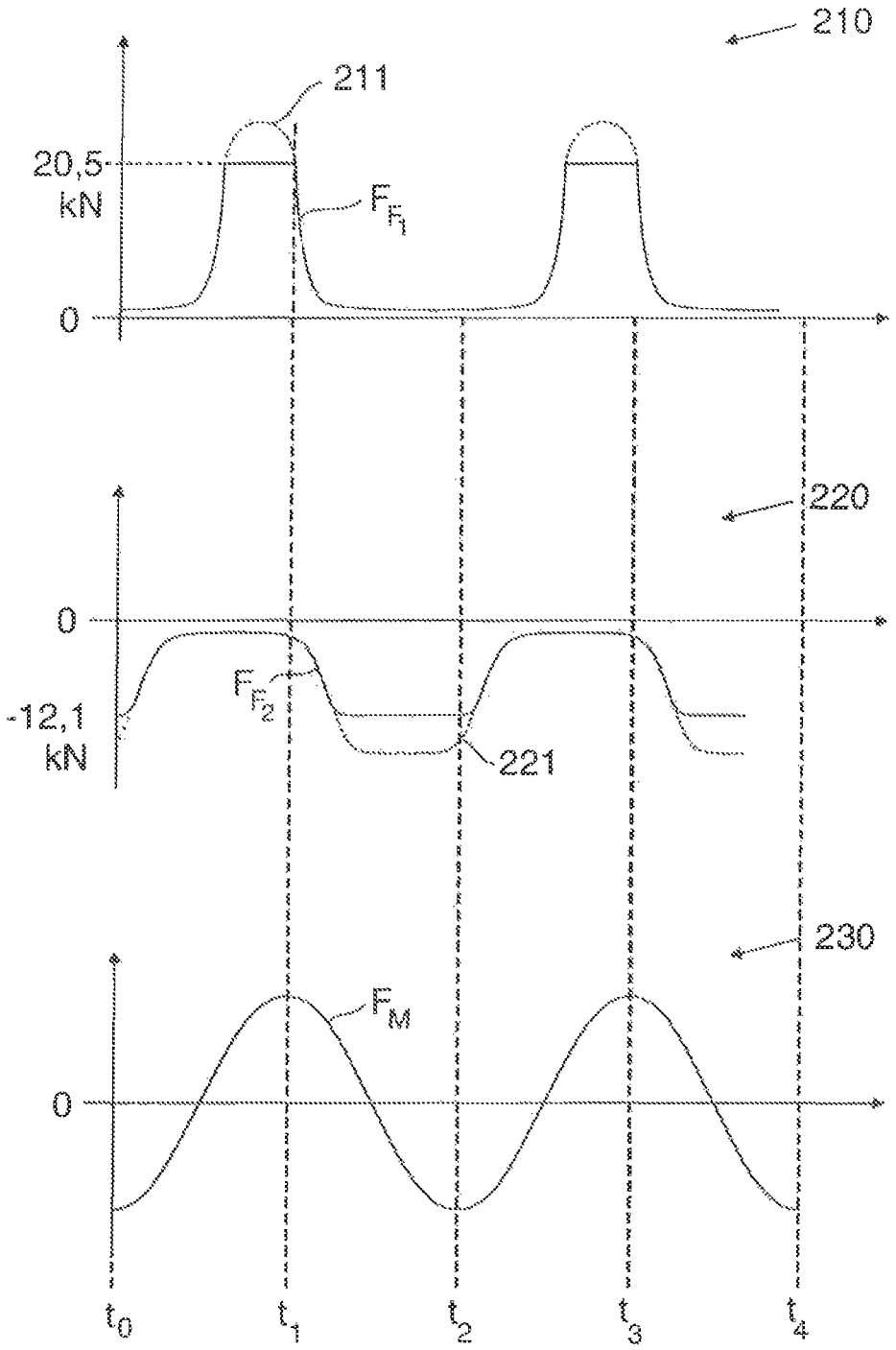
FIG. 2 shows two schematic force diagrams (FIGS. 2*a*, 2*b*) plotted against time, which can be achieved with this variant of a compression machine according to the invention.

FIG. 2*a* represent the fluid forces generated and the piston force of a reciprocating piston compressor according to FIG. 1*a*. A force is plotted on the vertical axis, and time t is plotted along the horizontal axis.

Curve 210 shows a first fluid force $F_{F1}$, which is exerted on piston 111 by fluid 112 during the first stage. Curve 220 shows a second fluid force $F_{F2}$, which is exerted on piston 111 by fluid 112 during the second stage. Curve 230 shows the piston force $F_M$. At times $t_1$ and $t_3$ reciprocating piston 111 is at reversal point $U_1$ and is changing from the first to the second stage. These are the time points at which fluid 112 is most compressed. At time points $t_0$, $t_2$ and $t_4$, reciprocating piston 111 is at reversal point $U_2$ and is changing from the second to the first stage. These are the time points at which fluid 112 is most decompressed.

The inventive increase in first mass $m_1$ with respect to reference mass $m_{ref}$ makes it possible to reduce the quantity-related maximum values of first and second fluid forces $F_{F1}$ and $F_{F2}$, which occur at the two reversal points $U_1$ and $U_2$. The dashed lines 211 and 221 show a plot of first and second fluid forces $F_{F1}$ and $F_{F2}$ at the two reversal points $U_1$ and $U_2$ for a reference reciprocating piston compressor 120 with a reference reciprocating piston 121 having reference mass $m_{ref}$. In this particular example, this reduces the maximum value of first fluid force $F_{F1}$ in a quantity-related manner to the value of 20.5 kN. The maximum value of second fluid force $F_{F2}$ is reduced in a quantity-related manner to the value of 12.1 kN. As was explained previously, the increase according to the invention of first mass $m_1$ figuratively has the same effect as a flywheel in an internal combustion engine, increasing the inertia of reciprocating piston 111. Thus, the extremes of the plot of the first and second fluid forces $F_{F1}$ and $F_{F2}$ against reference reciprocating piston compressor 121 are "truncated".

Figure 2B:
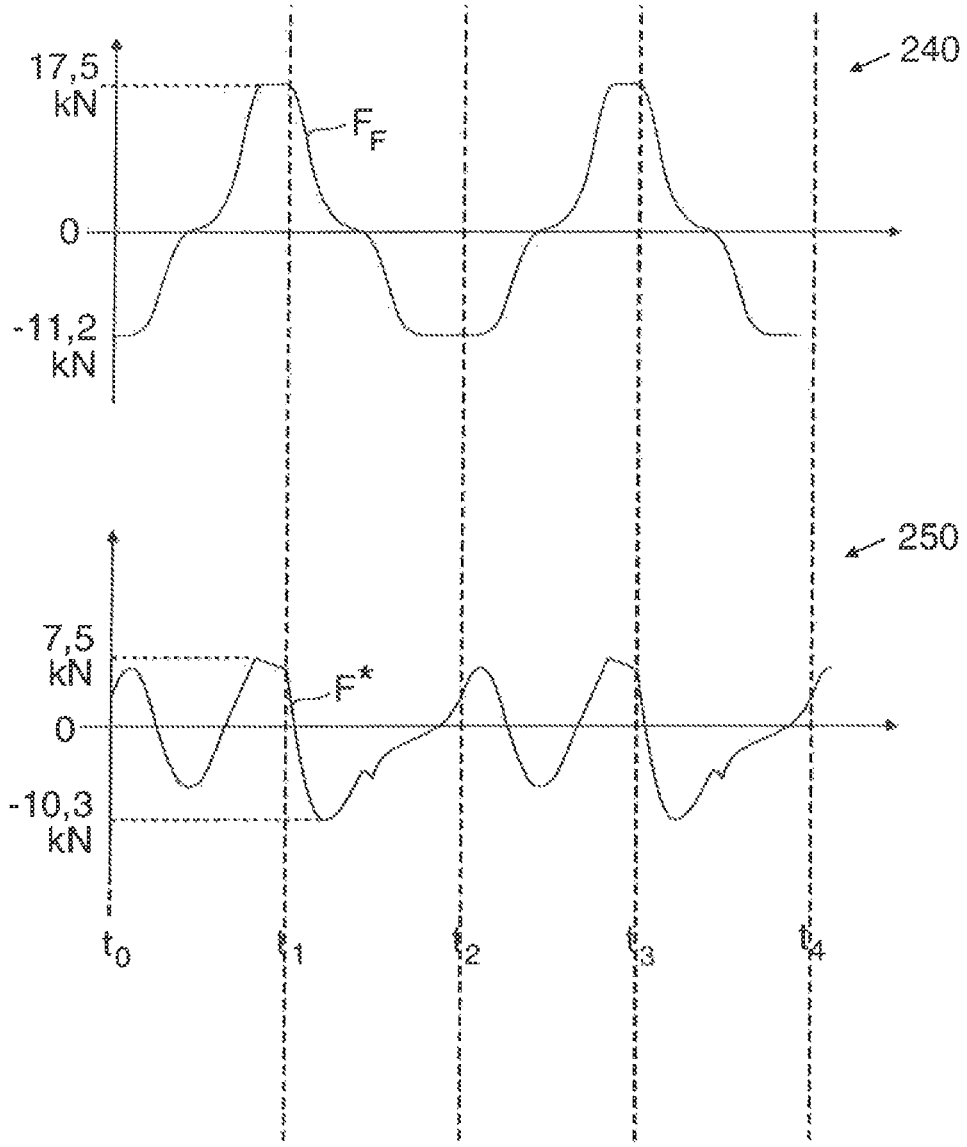

FIG. 2*b* shows a diagram similar to that in FIG. 2*a*. In this case, curve 240 shows fluid force $F_F$, which is the sum of first and second fluid forces $F_{F1}$ and $F_{F2}$. Curve 250 shows the resulting compression force F*, which is constituted by the difference between fluid force $F_F$ and piston force $F_M$. Reducing the quantity-related maximum values of the first and second fluid forces $F_{F1}$ and $F_{F2}$, has the effect of reducing the maximum values of fluid force $F_F$ correspondingly. In this example, the resulting compression force F* has a maximum value of 7.5 kN at the first reversal point and is thus less than the maximum driving force of 13.8 kN.

It should be noted that the amplitude, and therewith also the maximum value of the mass force and thus also of the piston force $F_M$, is increased when reciprocating piston compressor 110 and reference reciprocating piston compressor 120 are driven by the same linear motor 115 with the same maximum achievable driving force at the same frequency, since a larger mass has to be set in motion by the same driving force $F_A$. The inventive reduction of the maximum value of the resulting compression force F* by increasing first mass $m_1$ is not necessarily either larger or smaller than the resulting increase in the maximum value of inertial force $F_M$.

Indeed, as is shown by curve 250 in FIG. 2*b*, for example, there are several relatively high values, based on quantity. Increasing the inertial force has the effect of reducing the original maximum, whereas another high value in terms of quantity is increased in this example and becomes the "new" maximum in the compression process. Thus, the linear relation between increasing the inertial force increase and reducing the original maximum compression force is lost.

LISTING OF REFERENCE SYMBOLS

110 Compression machine, reciprocating piston compressor
111 Oscillating body, reciprocating piston
111*a* Oscillating movement
112 Fluid
113 Cylinder
114*a* Feed line
114*b* Drain line
115 Linear motor
120 Reference compression machine, reference reciprocating piston compressor
121 Reference body, reference reciprocating piston
121*a* Oscillating movement
130 Reference compression machine, reference reciprocating piston compressor
131 Reference body, reference reciprocating piston
131*a* Oscillating movement
133 Cylinder
210, 220, 230, 240, 250 Force diagrams
211, 221 Fluid force curve of a reference reciprocating piston compressor
A, $A_2$ Effective cross-sectional area
$U_1$, $U_2$ Reversal points
$F_M$ Piston force
$F_F$ Fluid force
F* Resulting compression force
$F_A$ Drive force
$m_1$ First mass
$m_{ref}$ Reference mass
F Factor
$f_{ref}$ Reference frequency
$f_{osc}$ Oscillating frequency

What is claimed is:

1. A compression machine, comprising:

an oscillating body (111) with a first mass ($m_1$) which oscillates in movement (111*a*) between two reversal points ($U_1$, $U_2$) for decompressing and compressing at least a portion of a fluid (112) in an alternating manner;

exerting a piston force ($F_M$) on the fluid for the fluid to exert a fluid force ($F_F$) on the oscillating body, wherein a resulting compression force (F*) is provided as a difference between the fluid force and the piston force; and using a maximum value of the resulting compression force (F*) when the oscillating body (111) used is less by a predetermined factor (F) than a maximum value of the resulting compression force (F*) when an oscillating reference body (121) having a reference mass ($m_{ref}$) is used in a reference compression machine (120) of the same construction, and using the fluid (112);

wherein the first mass ($m_1$) is greater than the reference mass ($m_{ref}$) by a percentage that is a function of the predetermined factor (F), and the maximum value of the resulting compression force (F*) would be reduced by the predetermined factor (F) by reducing an effective cross-sectional area (A) of the oscillating reference body (121) if the oscillating reference body (121) were used.

2. The compression machine of claim 1, wherein the oscillating body (111) oscillates between the two reversal points ($U_1$, $U_2$) at an oscillating frequency;

the maximum value of the resulting compression force (F*) of the oscillating body (111) with the oscillating frequency is less by a second predetermined factor than the maximum value of the resulting compression force (F*) when the oscillating reference body (121) having the reference mass ($m_{ref}$) and the oscillating frequency is used in the reference compression machine (120) of the same construction and using the fluid (112);

the oscillation frequency is greater than the reference frequency by a percentage amount that is a function of the second predetermined factor; and the maximum value of the resulting compression force (F*) would be reduced by the second predetermined factor by reducing an effective cross-sectional area (A) of the oscillating reference body (121) if the oscillating reference body (121) were used.

3. The compression machine of claim 2, wherein the second predetermined factor comprises values selected from the group consisting of between 0.2 and 0.9, and a second percentage comprises values selected from the group consisting of 0% up to 300%, 50%, 100%, 150%, 200%, 250% and 300%.

4. The compression machine of claim 1, wherein the maximum value of the resulting compression force (F*) when the oscillating body (111) is used is less than a maximum value of a drive force ($F_A$) that is supplied by a drive unit (115) of the compression machine.

5. The compression machine of claim 4, wherein the drive unit (115) comprises a linear motor.

6. The compression machine of claim 1, wherein the oscillating body (111) comprises a reciprocating piston, or optionally the compression machine (110) is a reciprocating piston compressor.

7. The compression machine of claim 1, wherein the predetermined factor (F) comprises a value between 0.2 and 0.9.

8. The compression machine of claim 1, wherein the percentage comprises values selected from the group consisting of 0% up to 300%, 50%, 100%, 150%, 200%, 250% and 300%.

9. A method for designing a compression machine (110) in which an oscillating body (111) oscillates between two reversal points ($U_1$, $U_2$), comprising:

oscillating movement (111*a*) of the oscillating body (111) between decompressing and compressing in alternating manner at least a portion of a fluid (112) of the machine;

exerting a piston force ($F_M$) with the oscillating body on the fluid (112);

exerting a fluid force ($F_F$) with the fluid on the oscillating body (111);

providing a resulting compression force (F*) as a difference between the fluid force ($F_F$) and the piston force ($F_M$);

selecting a first mass ($m_1$) of the oscillating body (111) such that a maximum value of the resulting compression force (F*) when the oscillating body (111) is used is less by a predetermined factor (F) than a maximum value of the resulting compression force (F*) when an oscillating reference body (121) having a reference mass ($m_{ref}$) is used in a reference compression machine (120) of the same construction as the compression machine (110) and using the fluid (112), wherein the first mass ($m_1$) is greater than the reference mass ($m_{ref}$) by a percentage that is a function of the predetermined factor (F); and reducing the maximum value of the resulting compression force (F*) by the predetermined factor (F) by reducing an effective cross-sectional area (A) of the oscillating reference body (121) if the oscillating reference body (121) were used.

10. The method of claim 9 for reducing the resulting compression force (F*), wherein said resulting compression force (F*) having been reduced does not sacrifice delivery capacity of said machine.

* * * * *